US005127685A

United States Patent [19]

Dallaire et al.

[11] Patent Number: 5,127,685

[45] Date of Patent: Jul. 7, 1992

[54] LATCH FOR USE IN WINDOW CONSTRUCTIONS

[75] Inventors: Raymond Dallaire; Dominique Dallaire, both of Quebec, Canada

[73] Assignee: Dallaire Industries, Ltd., Quebec, Canada

[21] Appl. No.: 663,147

[22] Filed: Mar. 1, 1991

[30] Foreign Application Priority Data

Mar. 1, 1990 [CA] Canada ..... 2011240

[51] Int. Cl.[5] ..... E05C 1/04; E05D 15/22

[52] U.S. Cl. ..... 292/175; 49/185; 292/42

[58] Field of Search ..... 292/32, 42, 137, 145, 292/163, 175, 183, 189; 49/181, 184, 185

[56] References Cited

U.S. PATENT DOCUMENTS

| | | | |
|---|---|---|---|
| 1,794,643 | 3/1931 | Raw | 292/175 |
| 2,768,852 | 10/1956 | Hicks | 292/175 |
| 3,425,164 | 2/1969 | Storlie et al. | 49/450 |
| 4,400,026 | 8/1983 | Brown, Jr. | 292/175 |
| 4,553,353 | 11/1985 | Simpson | 49/161 |
| 4,662,778 | 11/1986 | Simpson | 49/161 |
| 4,791,756 | 12/1988 | Simpson | 49/175 |
| 4,837,975 | 6/1989 | Simpson | 292/175 X |

FOREIGN PATENT DOCUMENTS

| | | | |
|---|---|---|---|
| 18126 | of 1890 | United Kingdom | 292/137 |

*Primary Examiner*—Richard E. Moore
*Attorney, Agent, or Firm*—James D. Hall

[57] ABSTRACT

A latch for use in window constructions, particularly vertically and horizontally sliding window constructions. The latch is generally mounted internally in a window sash frame so that its latch bolt protrudes from the sash to engage a guide slot in the main frame jamb or header of a window frame. The latch includes a thin rectangular base plate having upstanding bosses on its opposing ends which are pierced by vertical bores that pass through the base plate. The latch bolt is of substantially the same width as the base plate and slides over it. The bolt includes two openings spaced to receive the upstanding bosses on the base plate, each opening having a first lower region sized to slidably accommodate a boss and a second wider ovate upper region sized to slidably accommodate the head of a screw fastener. Two screw fasteners driven respectively through the vertical bores in the bosses on the ends of the base plate affix the latch to a window sash and secure the bolt to the base plate. A coil spring biases the bolt to its extended position. The base plate further includes two opposing short vertical walls with inturned wedge-shaped protrusions along their top edges which slidably grip longitudinal rail regions on opposite side of the middle of the latch bolt to maintain the latch in an assembled condition before it is attached to the sash of a window. A finger pull is also provided to facilitate manipulation of the latch.

15 Claims, 4 Drawing Sheets

LATCH FOR USE IN WINDOW CONSTRUCTIONS

The present invention relates to latches, and in particular to a novel latch for use in window constructions, especially vertically and horizontally sliding window constructions.

Latches for use in window constructions are well known. Latches of this type are described in the following United States patents:

U.S. Pat. No. 4,791,756—Simpson
U.S. Pat. No. 4,662,778—Simpson
U.S. Pat. No. 4,553,353—Simpson
U.S. Pat. No. 3,425,164—Storlie et al
U.S. Pat. No. 2,768,852—Hicks Each of the patents listed above describe a latch having a bolt which is slidably accommodated within a latch housing. One disadvantage of this type of latch is that the size of the housing occupies space in a window sash frame. As a result, the channel for accommodating the latch must be wide enough to accommodate the housing, thus correspondingly reducing the thickness of the side walls of the sash; or, the width of the bolt must be reduced to fit within a narrower housing, thus compromising the strength of the bolt. Other disadvantages include the general complexity of the design of the latches as described in the patents listed above and the fact that most of them are difficult to preassemble because they include one or more springs which are either not readily installable or are inclined to dislodge from their housing and cause performance problems during use.

SUMMARY OF THE INVENTION

It is an object of the present invention to provide a latch mechanism for use in window constructions which overcomes the major drawbacks of the prior art.

It is a further object of the invention to provide a latch mechanism which is readily assembled with a minimum of effort and which securely retains its bolt biasing spring during shipping and use.

It is yet a further object of the invention to provide a latch mechanism which offers substantially a maximum latch bolt cross-sectional area for a given operating space.

A latch mechanism in accordance with the invention is intended for use in window constructions. The latch mechanism includes a thin base plate having upstanding bosses on its opposing ends which are pierced by vertical bores that pass through the base plate, and a latch bolt which is substantially the same width as the base plate and slides over it. The bolt includes two openings spaced to receive the respective upstanding bosses on the base plate, each opening having a first lower region sized to slidably accommodate a base plate boss and a second ovate upper region sized to slidably accommodate the head of a screw fastener. Two screw fasteners driven respectively through the vertical bores in the base plate bosses secure both the bolt and the base plate to a window sash. The base plate further preferably includes two vertical walls located along the mid region of the longitudinal edges thereof. The vertical walls are provided with inwardly projecting wedge shaped protrusions along their top edges. The latch bolt is provided with an opposing pair of triangular longitudinal rails in indented regions located between the ovate openings in the bolt. The inwardly projecting top edges of the vertical walls of the base plate grip the rails on the bolt to retain the two parts in an assembled condition for shipping and handling prior to their installation on a window. The base plate further includes a vertically upstanding spring retainer positioned to retain a coil spring for constantly urging the latch bolt to an extended condition. The bolt also includes notches required for attaching a finger pull to the latch in order to facilitate its operation.

In specific terms, a latch in accordance with the invention for use in window constructions comprises:

A latch for use in window constructions of the horizontally or vertically sliding type wherein a window frame includes guide rails to permit reciprocal sliding movement of a sash in the window frame while the latch is cooperatively engaged with a slot in the guide rail, the sash being a rectangular sash adapted to receive the latch internally so that an end segement of the latch projects to engage the slot and the latch is manually operable from externally of the sash so that the latch may be released from its engagement to permit the sash to be pivoted away from the frame, the latch comprising:

a narrow flat latch base plate having a top side, an under side and opposed end regions with an upstanding boss on the top side of each end region, each boss including a vertical bore which pierces the boss and the base plate, a longitudinal slot to permit the insertion of a compression coil spring from the underside of the base plate and spaced inwardly of the boss on that end region, a groove in the top surface of the base plate for receiving the spring, which groove is continuous with an inner end of the slot, and a spring retainer wall at an end of the groove that is remote from the slot;

an elongated latch bolt having an outer end, an inner end and flat side surfaces, the latch bolt being longer than the base plate and at least as wide as the base plate on each of its outer and its inner ends, the bolt including a first and a second spaced-apart vertical opening for respectively accommodating the bosses on the base plate to permit limited reciprocal movement of the bolt on the base plate, the first and second openings including a narrow slot in a bottom surface of the latch bolt, the narrow slot having a vertical side wall with a height which is less than the height of the boss, and a wide superimposed slot for slidably accommodating the head of a screw fastener driven through the vertical bore in the boss, said first and second openings being located such that the outer end of the bolt overhangs the base plate for engaging the slot in a guide rail of a window frame when the latch is installed in a window sash, and the bolt further including a cavity for accommodating the spring, which cavity is located in its bottom surface between the first and second openings.

BRIEF DESCRIPTION OF THE DRAWINGS

The present invention will now be described by way of example only and with reference to the following drawings wherein.

DETAILED DESCRIPTION OF THE PREFERRED EMBODIMENT

Figure 1:
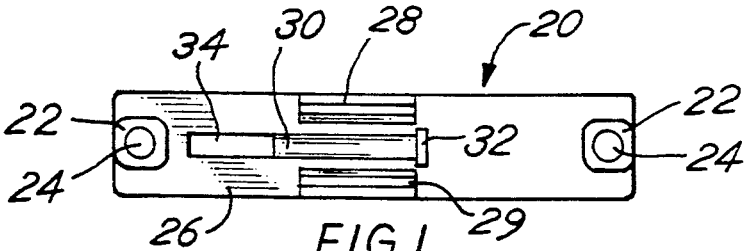
FIG. 1 is a top plan view of a base plate in accordance with the preferred embodiment of the invention.
Figure 2:
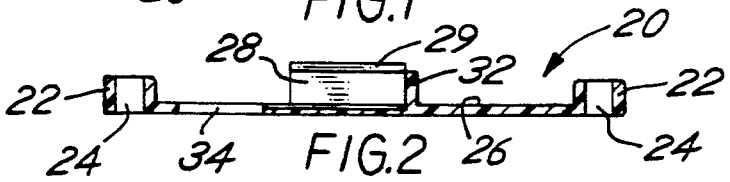
FIG. 2 is a longitudinal cross section taken through the center line of the base plate shown in FIG. 1.
Figure 3:
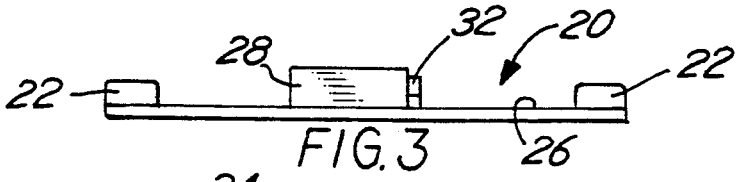
FIG. 3 is a side elevational view of the base plate shown in FIG. 1.
Figure 4:
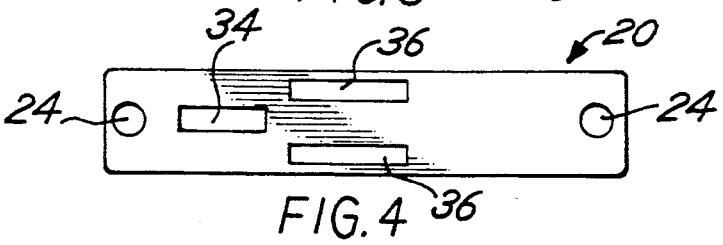
FIG. 4 is a bottom plan view of the base plate shown in FIG. 1.
Figure 5:
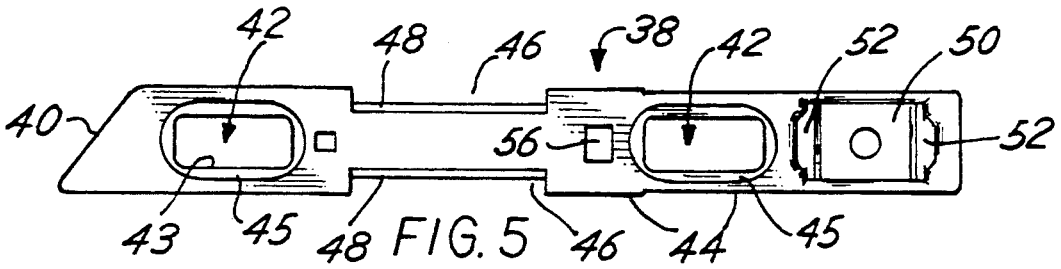
FIG. 5 is a top plan view of a latch bolt in accordance with the preferred embodiment of the invention.
Figure 6:
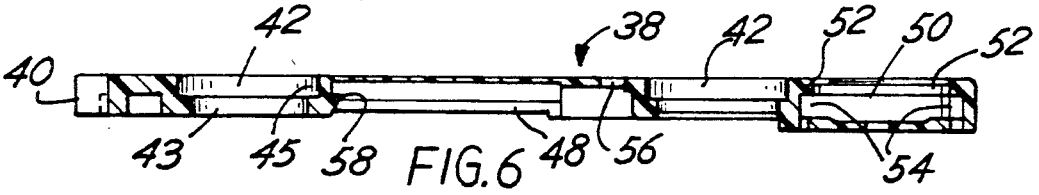
FIG. 6 is a longitudinal cross-section taken along the mid-line of the latch bolt shown in FIG. 5.
Figure 7:
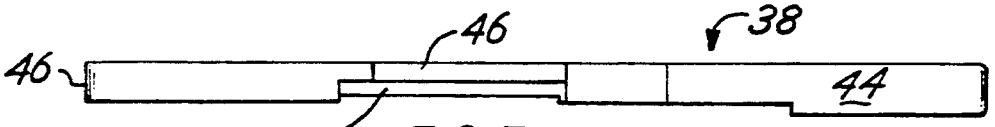
FIG. 7 is a side elevational view of the latch bolt shown in FIG. 5.

As shown in FIGS. 1 through 4, a latch base plate in accordance with the invention, generally indicated by the reference 20, includes a substantially square upstanding boss 22 on each of its opposing ends. Each boss includes a vertical bore 24, the purpose of which will be explained in detail hereinafter. The base plate has a generally smooth upper surface 26 and a pair of vertical walls 28 which are located in opposing relation along the longitudinal edges of the base plate 20. Each vertical wall 28 is provided along its inner top edge with a laterally projecting wedge shaped protrusion 29. The wedge shaped protrusions 29 cooperate with complementary surfaces on the latch bolt as will be explained hereinafter in more detail.

Located between vertical walls 28 is a narrow longitudinally oriented round-bottomed groove 30 which supports a coil spring for urging the latch bolt to an extended position. At the one end of the round-bottomed groove 30 is a spring retaining wall 32 and at the opposite end is a spring installation slot 34. Intermediate the vertical side walls 28 and the narrow round-bottomed groove are a pair of laterally spaced shorter slots 36 which communicate with the bottom and top surfaces of the latch base plate 20.

A latch bolt in accordance with the invention may be seen in FIGS. 5 through 8. The latch bolt, generally indicated by reference 38, shown in FIGS. 5 through 8 is a left hand latch. As understood by those skilled in the art, a given latch is either a left hand or right hand latch, and the two are not interchangeable. Of course, the only difference between a left hand and right hand latch is that the one is a mirror image of the other.

The bolt 38 includes an outer end 40 which has an angled face. The bolt further includes a pair of openings 42 for receiving bosses 22 of the base plate 20. The openings 42 are substantially rectangular in their narrow bottom portion 43 and ovate in their wider top portion 45. The reasons for this will be explained below:

Intermediate the openings 42 are opposed rectangular recessed areas 46 located in the side walls 44 of the latch bolt 38. The rectangular recessed areas include triangular rails 48 having narrow flat top edges upon which the wedge-shaped protrusions 29 of the vertical side walls 28 of the base plate ride when the bolt 58 is snapped onto the base plate 20. Near the inner end of bolt 38 is a substantially rectangular depression 50 which may be used as a finger pull for the bolt. The outwardly jogged notches 52 in the opposite ends of the depression 50 may be used to attach a remote finger pull having attachment legs with outwardly depending flanges which engage the recesses 54 (see FIG. 6) in the opposite ends of recess 50. An additional notch 56 is used to attach a preferred finger pull to the bolt, as shall be explained hereinafter in more detail.

Figure 8:
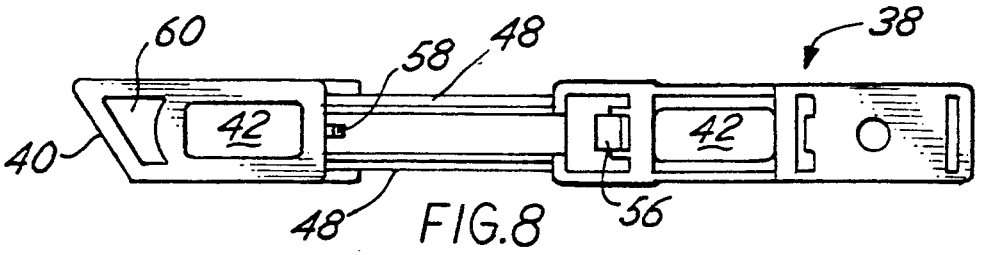
FIG. 8 is a bottom plan view of the latch bolt shown in FIG. 5.

As may be seen in FIG. 8, in the space between the bottom edges of the triangular rails 48 is a spring retaining ramp 58. The spring retaining ramp 58 prevents an end of a coil spring from disengaging the bolt once it is installed, as shall be explained below in some detail. The front end region 40 of the bolt 38 further includes a recess 60 in its bottom surface which is simply to economize on weight and material.

Figure 9:
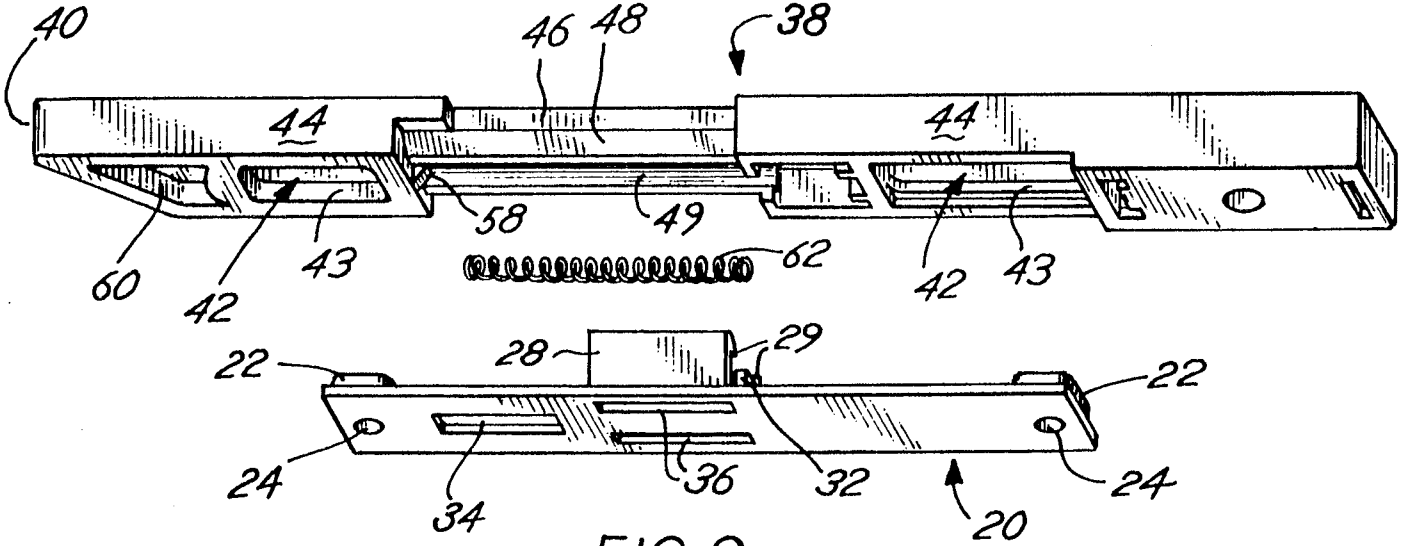
FIG. 9 is an exploded perspective view of the latch base plate and the latch bolt shown in FIGS. 1 and 5 respectively.
Figure 10:
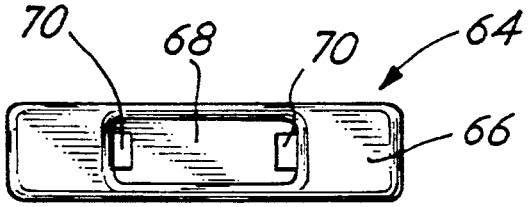
FIG. 10 is a top plan view of a finger pull in accordance with the preferred embodiment of the invention.
Figure 11:
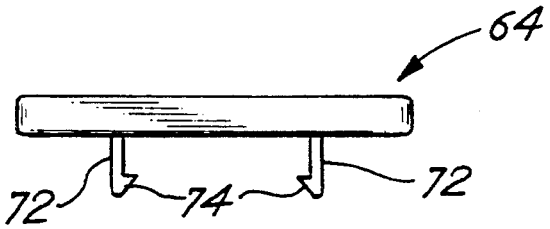
FIG. 11 is a side elevational view of the finger pull shown in FIG. 10.
Figure 12:
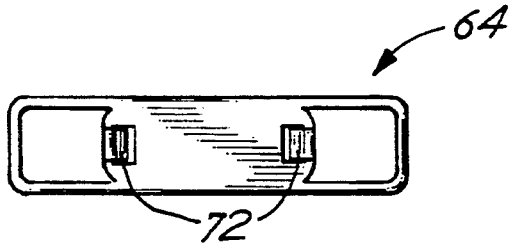
FIG. 12 is a bottom plan view of the finger pull shown in FIG. 10.
Figure 13:
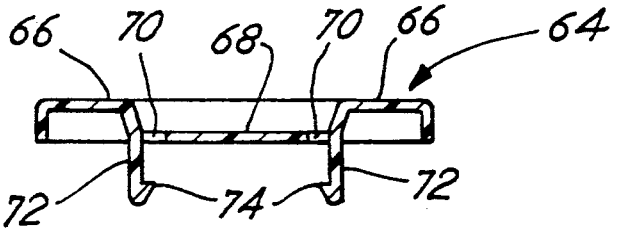
FIG. 13 is a longitudinal cross-sectional view taken along the center line of a finger pull shown in FIG. 10.

FIG. 9 shows an exploded perspective view of the latch bolt 38 and latch base plate 20 in accordance with the invention. The latch is assembled by pressing base plate 20 against the underside of the latch bolt 38, or vice versa, in the orientation shown in FIG. 9. The vertical side walls 28 of the latch base plate 20 slide over the triangular rails 48 and clip over the top edges of the rails in rectangular recesses 46 to retain the bosses 22 in the openings 42 of the latch bolt 38. A coil spring 62 is then inserted by pushing one end of the spring upwardly through the rectangular spring installation slot 34 in the base plate 20. The spring is guided by the rounded groove 49 between rails 48 into the opposing narrow round bottomed groove 30 (see FIG. 1) and against the spring retaining wall 32. The free end of the spring is then pushed upwardly through slot 34 and, due to the tapered configuration of the spring retaining ramp 58 (see FIG. 6) the free end of the spring glides upwardly and over the end of the ramp where it locks over the top of the ramp to be permanently retained in its position. The only way to remove the spring 62 after assembly of the latch is to pry the vertical side walls 28 laterally outwards to release the base plate 20 from the bolt 38.

FIGS. 10 through 13 illustrate a preferred embodiment of a finger pull, generally indicated by the reference 64, for use with a latch in accordance with the invention. The finger pull includes a smooth top surface 66 with rounded corners and rounded edges. Centered in the top surface 66 is a substantially rectangular recess 68 having slots 70 in each of its ends. The finger pull is further provided with a pair of supporting legs 72 having inwardly turned triangular flanges 74 which clip to the recessed edges of notches 52 and 56 (see FIG. 6). Other finger pulls are, of course, equally adaptable for use with a latch in accordance with the invention.

Figure 14:
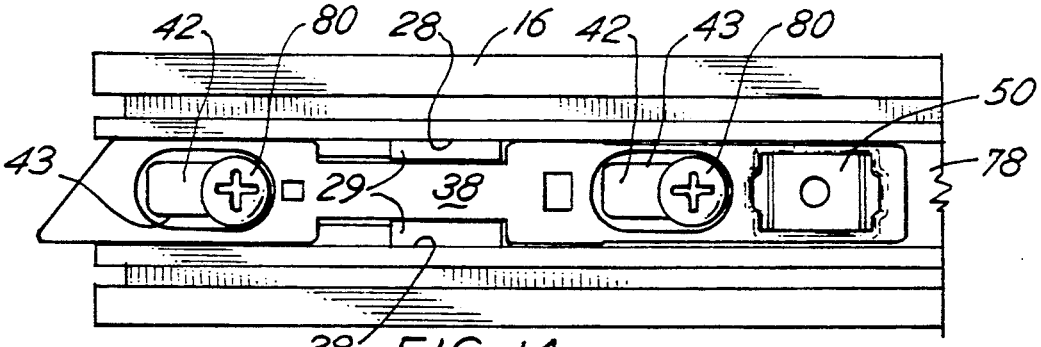
FIG. 14 is a top plan view of a latch mechanism in accordance with the invention, shown installed in a window sash.

FIG. 14 shows a latch in accordance with the invention installed in a window sash 76. Window sash 76 includes a central groove 78 for housing the latch. This window is shown without a sash cap and the latch may be operated using the built in finger pull recess 50. As is apparent, the latch is retained in the central groove 78 of the window sash 76 by a pair of screw fasteners 80 (see FIG. 15). Screw fasteners 80 permit a sliding movement of the bolt 38 while securely retaining the bolt in the central groove 78. As may be seen in FIG. 15, the screw fasteners 80 are securely tightened against the tops of the upstanding bosses 22 on base plate 20. The clearance between the bottom edges of screw fastener 80 and the top edges of the lower rectangular region 43 in openings 42 permits the bolt to slide over base plate 20. On the other hand, the manner in which the heads of screw fasteners 80 overhang the lower rectangular region 43 of openings 42 prevents the bolt 38 from being lifted away from the base plate and the window sash 76 (see FIG. 14). The position of the coil spring 62 is clearly visible in FIG. 15. As is apparent, the coil spring 62 is retained between the spring retainer wall 32 and the spring retainer ramp 58. Regardless of the number of times the outer end 40 of the latch is retracted, the spring remains securely retained in its position.

Figure 15:
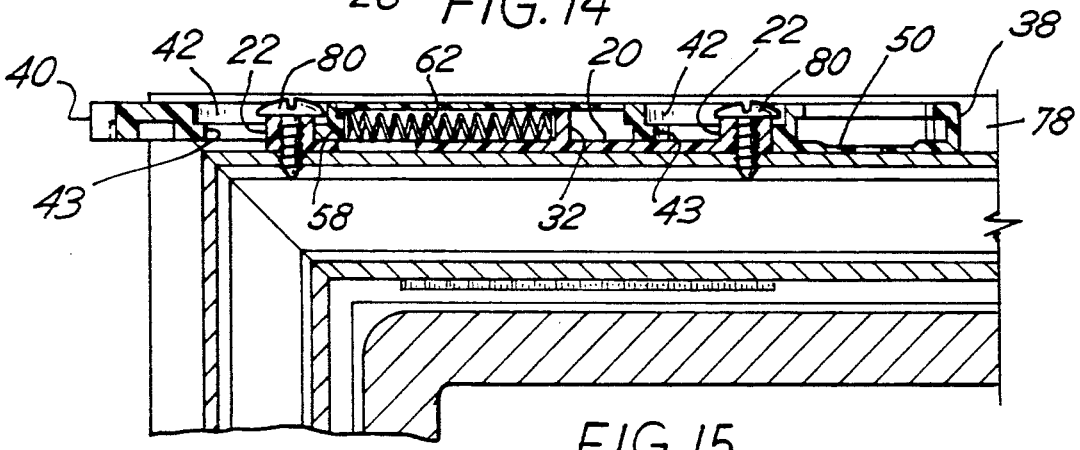
FIG. 15 is a longitudinal cross-sectional view taken through the center of the latch shown in FIG. 14.
Figure 16:
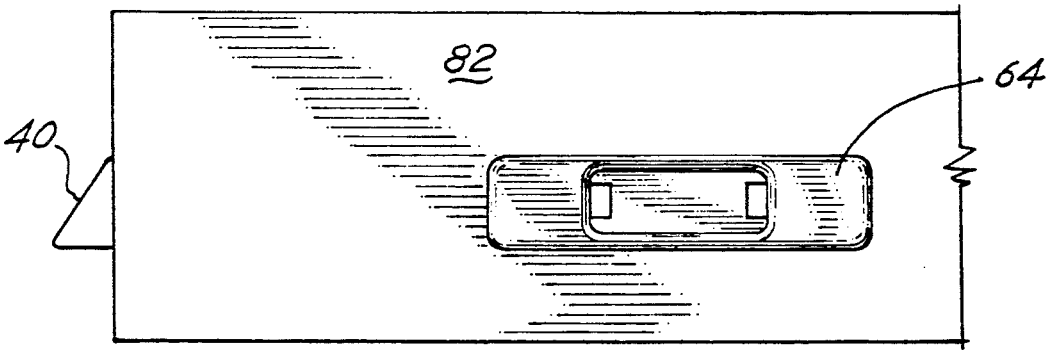
FIG. 16 is a top plan view of a latch in accordance with the invention installed under a window sash meeting rail and equipped with a finger pull.

FIG. 16 illustrates the latch shown in FIGS. 14 and 15 with a meeting rail 82 installed on the edge of the sash, and a finger pull 64 installed on the latch to permit easy manipulation thereof. The sash cap 82 includes a meeting rail (not illustrated) which carries weatherstripping (not illustrated). The sash cap 82 is therefore a most the desirable element of a window construction. If the sash cap 82 is installed, the finger pull recess 50 is remote and difficult to use. It is therefore preferable to install a raised finger pull 64 as shown in FIG. 16.

Figure 17:
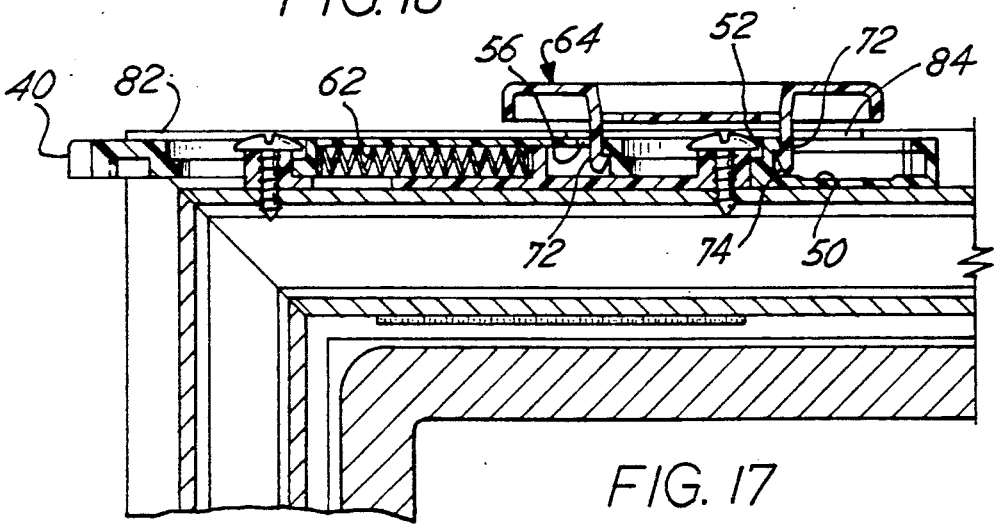
FIG. 17 is a longitudinal cross section taken through the center line of the latch shown in FIG. 16.

As may be seen in FIG. 17, the support legs 72 of the finger pull 64 are pressed downwards through a rectangular slot 84 cut through the sash cap 82. The right leg 72 of the finger pull 64 is pushed into the left side jog 52 in finger pull recess 50 and the left leg 72 is pushed through rectangular slot 56 as may be seen in FIG. 17.

The latch in accordance with the invention is preferably injection molded from polycarbonate or a similar thermoplastic which has good friction and wear resistance.

In use, the latch engages a guide rail in the main frame of either a vertically or horizontally sliding window frame. If the window is to be pivoted into the building for cleaning or maintenance, the outer ends 40 of the latch or latches of the window are retracted by use of the finger pull 65, or some equivalent, and the window is swiveled inwardly or removed from its frame as the case may be. As noted earlier, the advantage of the latch in accordance with the invention is the fact that it requires a minimum operating space and operates flawlessly for many years without loosing its biasing spring.

The embodiments of the invention which have been hereto described are intended to be exemplary only, the scope of the invention being limited solely by the scope of the appended claims.

We claim:

1. A latch for use in window constructions of the horizontally or vertically sliding type wherein a window frame includes guide rails to permit reciprocal sliding movement of a sash in the window frame while the latch is cooperatively engaged with a slot in the guide rail, the sash being a rectangular sash adapted to receive the latch internally so that an end segment of the latch projects to engage the slot and the latch is manually operable from externally of the sash so that the latch may be released from its engagement to permit the sash to be pivoted away from the frame, the latch comprising:

a narrow flat latch base plate having a top side, an under side and opposed end regions with an upstanding boss on the top side of each end region, each boss including a vertical bore which pierces the boss and the base plate, a longitudinal slot to permit the insertion of a compression coil spring from the underside of the base plate and spaced inwardly of the boss on that end region, a groove in the top surface of the base plate for receiving the spring, which groove is continuous with an inner end of the slot, and a spring retainer wall at an end of the groove that is remote from the slot;

an elongated latch bolt having an outer end, an inner end and flat side surfaces, the latch bolt being longer than the base plate and at least as wide as the base plate on each of its outer and its inner ends, the bolt including a first and a second spaced-apart vertical opening for respectively accommodating the bosses on the base plate to permit limited reciprocal movement of the bolt on the base plate, the first and second openings including a narrow slot in a bottom surface of the latch bolt, the narrow slot having a vertical side wall with a height which is less than the height of the boss, and a wide superimposed slot for slidably accommodating the head of a screw fastener driven through the vertical bore in the boss, said first and second openings being located such that the outer end of the bolt overhangs the base plate for engaging the slot in a guide rail of a window frame when the latch is installed in a window sash, and the bolt further including a cavity for accommodating the spring, which cavity is located in its bottom surface between the first and second openings.

2. The latch for use in window constructions as recited in claim 1 wherein the base plate further includes a pair of opposed vertical side walls disposed along opposite longitudinal edges of the base plate, said side walls having inwardly directed wedge-shaped protrusions along an inner side of a top edge thereof; and the latch bolt includes opposed rectangular recesses in each surface for cooperatively receiving the side walls of the base plate, said recesses including rails upon which the wedge-shaped protrusions of the side walls are slidably accommodated so that the wedge-shaped protrusions lock the base plate to the latch bolt to facilitate handling and shipping of the latch while permitting limited reciprocal movement of the latch bolt with respect to the base plate.

3. The latch for use in window constructions as recited in claim 1 wherein the cavity in the bottom surface of the latch bolt includes a spring retainer ramp, which ramp is located at a front end of the cavity, the ramp comprising a wedge-shaped protrusion with an angled bottom face so that an open front end of a spring pushed upwards through the longitudinal slot in the base plate when the latch bolt is positioned on the base plate will slide over and end of the spring retainer ramp and the ramp will slide into the open end of the spring to lock the spring in the cavity.

4. A latch for use in a window construction as recited in claim 1 wherein the narrow slot in the latch bolt is rectangular, the superimposed wider slot in the latch bolt is ovate, and each boss is substantially square in cross-section.

5. A latch for use in a window construction as recited in claim 1 wherein the latch bolt has an angled face on its outer end.

6. A latch for use in a window construction as recited in claim 1 wherein the latch bolt overhangs a rear end of the base plate and includes a downwardly stepped edge in the overhang for abutment with that end of the base plate so that the stepped edge limits the forward travel of the latch bolt.

7. A latch bolt for use in a window construction as recited in claim 1 wherein a top surface of the latch bolt includes a rectangular depression for use as a finger pull.

8. A latch bolt for use in a window construction as recited in claim 1 wherein a top surface of the latch bolt includes at least two spaced-apart notches for attaching supporting legs of a finger pull to the latch bolt.

9. A latch for use in window constructions of the horizontally or vertically sliding type wherein a window frame includes guide rails to permit reciprocal sliding movement of a sash in the window frame while the latch is cooperatively engaged with a slot in the guide rail, the sash being a rectangular sash adapted to receive the latch internally so that an end segment of the latch projects to engage the slot and the latch is manually operable from externally of the sash so that the latch may be released from its engagement to permit the sash to be pivoted away from the frame, the latch comprising:

a flat latch base plate having a smooth flat top surface, a flat underside and opposed square ends with an upstanding boss which is transversely centered on each end region, each boss including a vertical bore which pierces the boss and the base plate, a longitudinal slot to permit the insertion of a compression coil spring from a front end of the underside of the base plate, said slot being located inwardly of the boss on that end of the base plate, a groove in the top surface of the base plate for receiving the spring, which groove is continuous with an inner end of the slot, and upstanding side walls disposed along longitudinal edges of the base plate on opposite sides of the groove, said sidewalls including inwardly protruding wedge-shaped portions along a respective top edge thereof; and an elongated latch bolt having an outer end with an angled face, an inner end and flat side surfaces, the latch bolt being longer than the base plate and at least as wide as the base plate on each of the outer end and the inner end, the bolt including a first and second spaced apart vertical opening for respectively accommodating the bosses on the base plate to permit limited reciprocal movement of the bolt on the base plate, the first and second openings including a narrow slot on a bottom surface of the latch bolt, the narrow slot having a vertical side wall with a height which is less than the height of the bosses, and a wider superimposed slot for slidably accommodating the head of a screw fastener driven through the vertical bore in the boss, said first and second openings being located such that the outer end of the bolt overhangs the base plate for engaging the slot in the guide rail of a window frame when the latch is installed in a window sash, the bolt further including a cavity for accommodating the spring, which cavity is located in the bottom surface of the latch bolt between the first and second openings, and further including an opposed recess in each side wall of the latch bolt for accommodating the upstanding side walls of the base plate, each recess including a rail for slidably accommodating the wedge-shaped portions of the side walls, whereby the wedge-shaped portions of the side walls engage the rails of the latch bolt when the latch bolt is pressed against the base plate, to slidably retain the base plate and the latch bolt together as a latch unit, and the latch unit is affixed to a window sash by a screw fastener driven through the vertical bore in each boss and into the window sash frame.

10. The latch for use in window constructions as recited in claim 9 wherein the cavity in the bottom surface of the latch bolt includes a spring retainer ramp, which ramp is located at a front end of the cavity, the ramp comprising a wedge-shaped protrusion with an angled bottom face so that an open front end of a spring pushed upwards through the longitudinal slot in the base plate when the latch bolt is positioned on the base plate will slide over an end of the spring retainer ramp and the ramp will slide into the open end of the spring to lock the spring in the cavity.

11. A latch for use in a window construction as recited in claim 9 wherein the narrow slot in the latch bolt is rectangular, the superimposed wider slot in the latch bolt is ovate, and each boss is substantially square in cross-section.

12. A latch for use in a window construction as recited in claim 9 wherein the latch bolt has an angled face on its outer end.

13. A latch for use in a window construction as recited in claim 9 wherein the latch bolt overhangs a rear end of the base plate and includes a downwardly stepped edge in the overhang for abutment with that end of the base plate so that the stepped edge limits the forward travel of the latch bolt.

14. A latch bolt for use in a window construction as recited in claim 9 wherein a top surface of the latch bolt includes a rectangular depression for use as a finger pull.

15. A latch bolt for use in a window construction as recited in claim 9 wherein a top surface of the latch bolt includes at least two spaced-apart notches for attaching supporting legs of a finger pull to the latch bolt.

* * * * *